US007522736B2

(12) United States Patent
Adcock et al.

(10) Patent No.: US 7,522,736 B2
(45) Date of Patent: Apr. 21, 2009

(54) SYSTEMS AND METHODS FOR MICROPHONE LOCALIZATION

(75) Inventors: John Adcock, Menlo Park, CA (US); Jonathan Foote, Menlo Park, CA (US)

(73) Assignee: Fuji Xerox Co., Ltd., Tokyo (JP)

( * ) Notice: Subject to any disclaimer, the term of this patent is extended or adjusted under 35 U.S.C. 154(b) by 818 days.

(21) Appl. No.: 10/840,389

(22) Filed: May 7, 2004

(65) Prior Publication Data

US 2005/0249360 A1 Nov. 10, 2005

(51) Int. Cl.
*H04R 3/00* (2006.01)

(52) U.S. Cl. ..... 381/92; 381/122; 367/125; 367/129

(58) Field of Classification Search ..... 381/92, 381/26, 122, 56; 367/127, 129, 124, 125
See application file for complete search history.

(56) References Cited

U.S. PATENT DOCUMENTS

| | | | | |
|---|---|---|---|---|
| 5,600,727 | A * | 2/1997 | Sibbald et al. | 381/26 |
| 5,901,232 | A * | 5/1999 | Gibbs | 381/92 |
| 6,469,732 | B1 * | 10/2002 | Chang et al. | 348/14.08 |
| 6,925,296 | B2 * | 8/2005 | Mattisson | 455/355 |
| 7,039,199 | B2 * | 5/2006 | Rui | 381/92 |
| 7,221,622 | B2 * | 5/2007 | Matsuo et al. | 367/125 |
| 2005/0008169 | A1 * | 1/2005 | Muren et al. | 381/92 |
| 2005/0175190 | A1 * | 8/2005 | Tashev et al. | 381/92 |

OTHER PUBLICATIONS

U.S. Appl. No. 10/629,403, filed Jul. 28, 2003, Liu et al.
U.S. Appl. No. 10/612,429, filed Jul. 2, 2003, Liu et al.

Barry Brumitt and Steven Shafer, "Better Living Through Geometry", CHI Workshop on Situated Interaction in Ubiquitous Computing, Apr. 2000.

Joshua M. Sachar, Harvey F. Silverman and William R. Patterson III, "Position Calibration of Large-Aperture Microphone Arrays", Proceedings of ICASSP 2002, II, pp. 1797-1881.

J. Hightower, C. Vakili, G. Borriello, and R. Want, "Design and Calibration of the SpotON Ad-Hoc Location Sensing System", unpublished, Aug. 2001. http://citeseer.nj.nec.com/hightower01design.html.

Andy Ward, Alan Jones, and Andy Hopper. "A New Location Technique for the Active Office", IEEE Personal Communications, 4(5):42-47, Oct. 1997. http://citeseer. nj.nec.com/ward97new.html.

(Continued)

*Primary Examiner*—Xu Mei
*Assistant Examiner*—Jason R Kurr
(74) *Attorney, Agent, or Firm*—Sughrue Mion, PLLC

(57) ABSTRACT

Systems and methods determine the location of a microphone with an unknown location, given the location of a number of other microphones by determining a difference in an arrival time between a first audio signal generated by and microphone with a known location and a second audio signal generated by another microphone with an unknown location, wherein the first and second audio signals are a representation of a substantially same sound emitted from an acoustic source with a known location; determining, based on at least the determined difference in arrival time, a distance between the acoustic source with the known location and the microphone with the unknown location; and determining, based on the determined distance between the acoustic source with the known location and the microphone with the unknown location, the location of the unknown microphone.

19 Claims, 5 Drawing Sheets

OTHER PUBLICATIONS

Xing Chen, James Davis, and Philipp Slusallek, "Wide Area Camera Calibration Using Virtual Calibration Objects", IEEE CVPR 2000, http://graphics.stanford.edu/papers/wide_area_calibration/cvpr16.pdf.

Hans-Gerd Mass, "Image Sequence Based Automatic Multi-Camera System Calibration Techniques", International Archives of Photogrammetry and Remote Sensing vol. 32, Part V, 1998, http://www.tu-dresden.de/fghgipf/forschung/material/publ_maas/.

Steven Gottschalk and John F. Hughes, "Autocalibration for Virtual Environments Tracking Hardware", Proceedings of the 20th annual conference on Computer graphics and interactive techniques, 1993, http://doi.acm.org/10.1145/166117.166124.

M. S. Brandstein, J. E. Adcock and H. F. Silverman, "A Practical Time-Delay Estimator for Localizing Speech Sources With A Microphone Array", Computer, Speech and Language, vol. 9, pp. 153-169, Sep. 1995, http://www.lems.brown.edu/pub/array/papers/cs195.ps.gz.

David P. Robinson and Ian W. Marshall, "An Iterative Approach to Locating Simple Devices in an ad-hoc Network", London Communications Symposium, 2002, http://citeseer.nj.nec.com/547636.html.

Rainer Lienhart, Igor Kozintsev and Stefan Wehr, "Universal Synchronization Scheme for Distributed Audio-Video Capture on Heterogeneous Computing Platforms", *proceedings of ACM Multimedia 2003*.

* cited by examiner

SYSTEMS AND METHODS FOR MICROPHONE LOCALIZATION

BACKGROUND OF THE INVENTION

1. Field of Invention

This invention relates to systems and methods for locating an unknown microphone using microphones with known locations.

2. Description of Related Art

When a number of people participate in a meeting, teleconference, news conference, lecture, or the like, it is advantageous to determine the location of a speaker in order to, for example, focus lighting on the speaker, point a camera at the speaker, and/or activate a microphone nearest a speaker.

Various methods have been proposed to estimate the location of such a speaker. For example, the SpotON system utilizes a dedicated tracking device worn on the speaker. However, employing a separate tracking system, requires the cost and resources necessary to set up, use, and manage a system dedicated solely to the tracking of a speaker wearing a tracking device. Furthermore, if someone without a tracking device speaks, for instance an audience member or late arrival, they cannot be tracked by the system.

Other methods, in an attempt to avoid the increased cost and resource expenditure associated with a separate tracking system, use an array of microphones, each microphone having a known position, to triangulate the location of a speaker or other object based sounds emitted by the speaker or object. However, these systems are only capable of tracking various objects that emit sounds. As such, a speaker or object cannot be located until he, she, or it emits a sound. As a result, a speaker's or object's location cannot be determined until after they emit a sound.

SUMMARY OF THE INVENTION

Various exemplary embodiments of this invention provide systems and methods for determining the location of a microphone with an unknown location, given the location of a number of other microphones. Typically, conference rooms, lecture halls, news rooms, and the like already have an integrated audio system. As a result, the various exemplary embodiments of the invention enable the location of a speaker or an object in a room, without the need for a separate dedicated locating system and without it being necessary for the speaker or object to emit a sound before it may be located.

The systems and methods according to the various exemplary embodiments of the invention thus utilize a number of the various microphones in the room with known locations to determine the location of any other microphone whose signal is being received by the audio system.

Accordingly, various exemplary embodiments of this invention provide a method for determining the location of a microphone, including determining a difference in an arrival time between a first audio signal generated by one microphone with a known location and a second audio signal generated by another microphone with an unknown location, wherein the first and second audio signals are a representation of a substantially same sound emitted from an acoustic source with a known location; determining, based on at least the determined difference in arrival time, a distance between the acoustic source with the known location and the microphone with the unknown location; and determining, based on the determined distance between the acoustic source with the known location and the microphone with the unknown location, the location of the unknown microphone.

Various exemplary embodiments provide a system for determining the location of a microphone, including an acoustic source locating, circuit, routine, or application that determines the location of one or more acoustic sources using two or more microphones with known locations; and an unknown location estimating circuit, routine, or application that determines the location of one or more unknown microphones, based on audio signals generated by a microphone with a known location and an audio signal generated by another microphone with an unknown location, wherein the audio signals are a representation of a substantially same sound emitted from the same acoustic source with a known location.

BRIEF DESCRIPTION OF THE DRAWINGS

Exemplary embodiments of the invention will now be described with reference to the accompanying drawings, wherein.

DETAILED DESCRIPTION OF EXEMPLARY EMBODIMENTS

Figure 1:
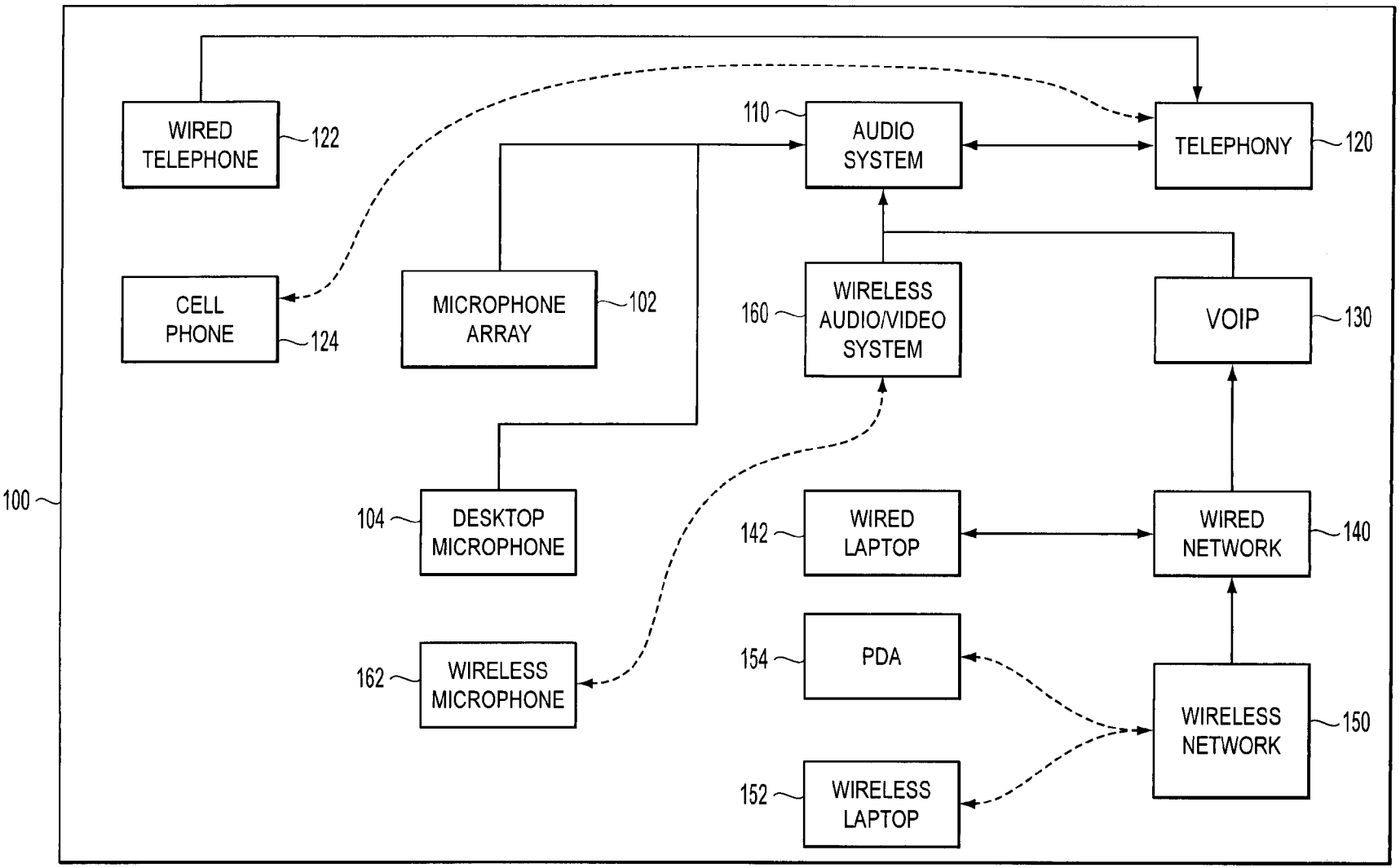
FIG. 1 shows a representative layout of a conference room.

Modern conference rooms, news rooms, offices, convention halls, and the like frequently contain moveable wired audio resources, such as desktop microphones and wired laptop computers, and mobile wireless audio resources, such as wireless handheld or lapel microphones, wireless laptop computers, personal digital assistants (PDAs), wireless palmtop computers, wireless tablet computers, cell phones, and the like. For example, as shown in FIG. 1, a conference room 100 may contain an audio system 110 that controls a microphone array 102, for instance, attached to a podium or arranged throughout the room 100. The audio system may also control one or more desktop microphones 104, for example individual microphones arranged around a conference table.

In addition to the microphones 102, 104 directly attached to the audio system 110, a telephony system 120, a wireless AV system 160, and a VOIP (Voice Over Internet Protocol) network 130, in which audio data may be associated with individual IP addresses and transmitted on a wired network 140 and/or wireless network 150, may be connected to the audio system 110. As shown in FIG. 1, this would allow the audio system to receive audio signals from wireless microphones 162, for example worn by various speakers, and microphones incorporated into wired phones 122, cell phones 124, PDAs 154, wired laptops 142, wireless laptops 152.

The systems and methods according to the various exemplary embodiments of the invention thus utilize a number of the various microphones in a room with known locations, for example a pre-positioned microphone array 102, pre-positioned desktop microphones 104, pre-positioned wired telephones 122, and/or any other pre-positioned or permanently placed microphone or device with a microphone that has a known location, to determine the location of any other microphone whose signal is being received by the audio system 110.

As a result, the systems and methods according to the various exemplary embodiments of the invention can determine the location of a microphone, and a person or object associated with that microphone, without the person or object associated with the microphone having to first emit a sound. This is particularly useful when it is necessary to know the location of an object or person associated with a microphone before they speak or make a sound. For instance, during a teleconference or news conference it may be necessary to quickly focus, for example a camera or light, from one speaker to the next as soon as or just before they speak. Furthermore, when the unknown microphone is incorporated into a device such as a wired lap top 142, wireless laptop 152, PDA 154, or a cell phone 124, and the location of the device can be determined according to the various exemplary embodiments of the invention, it will be possible to send electronic information to that particular device without knowing where the device is ahead of time.

Additionally, a microphone located through the methods described herein, rather than being used to locate a person or machine, can be incorporated into the extant audio system of, for example, a conference room. As a result, the located microphone may be used to augment the existing microphone resources in either a switched microphone system or a multi-microphone speech enhancement system which requires the microphone location to function properly. such microphone systems may include, for example, a delay-and-sum beamformer, or any other electronically steerable microphone array systems that generally require knowledge of the microphone placements.

Figure 2:
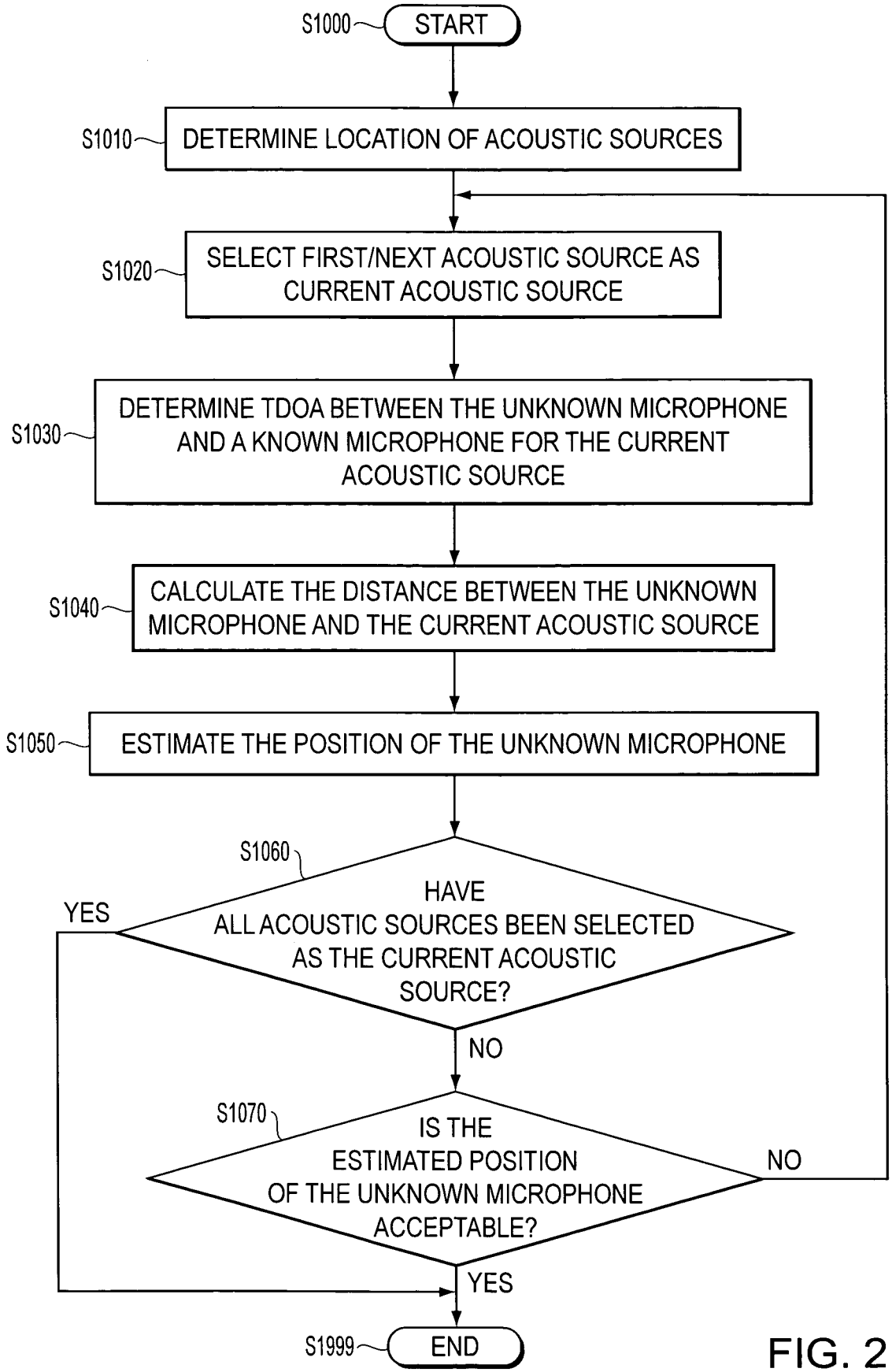
FIG. 2 is a flowchart that shows an exemplary embodiment of a method for determining a location of an unknown microphone according the invention.

FIG. 2 is a flowchart outlining one exemplary embodiment of a method for determining a location of an unknown microphone using a plurality of microphones with known locations according the invention. For ease of explanation, this exemplary embodiment is limited to two dimensions. As a result, this embodiment discloses a method for determining the location of an unknown microphone in a two dimensional plane. However, as discussed later with respect to various other exemplary embodiments, the method is easily adapted for use in three dimensions.

As discussed above, in various exemplary embodiments, the systems and methods according to the invention include plurality of microphones, each with a known location, one or more acoustic sources capable of emitting a sound, and at least one microphone with an unknown location. Additionally, both the known microphones' signals and the unknown microphone's or microphones' signals are being received by an audio system. Therefore, unless otherwise noted below, it is assumed for the purpose of the following exemplary embodiments that each of these elements are present.

As shown in FIG. 2, operation of the method begins in step S1000. As discussed above, the location of a plurality of microphones is already known. Then, in step S1010, the location of one or more acoustic sources is/are determined. The location of the acoustic sources may be determined in a number of ways. The locations may be determined based on location information already known, for example, a speaker at a conference with an assigned seat or a sound emitted from a fixed speaker with a known location. The location of the acoustic sources may also be determined using a dedicated tracking system such as SpotON. In the event that sources with known locations or a separate tracking system are not available, the location of the number of acoustic sources may be determined using the plurality of microphones with known locations using any of a variety of known acoustic source location finding technologies, for example, frequency-based delay estimation. Frequency based delay estimation is described in "M. S. Brandstein, J. E. Adcock, and H. F. Silverman, "A Practical Time-Delay Estimator for Localizing Speech Sources with a Microphone Array," Computer, Speech and Language, Volume 9, pages 153-169, September 1995, which is incorporated herein in its entirety.

Once the locations of a number of acoustic sources is known, operation continues to step S1020. In step S1020, a first or next acoustic source with a known location is selected as the current acoustic source. Then, in step S1030 the Time Difference of Arrival (TDOA) between a known microphone (i.e., one of the plurality of microphones whose location is already known) and the unknown microphone is determined. Essentially, the TDOA is the difference in time between the arrival of an audio signal representing a sound emitted by an acoustic source and transmitted by one microphone and the arrival of an audio signal representing the substantially same sound emitted by the same acoustic source and transmitted by another microphone. Therefore, if the distance between the current acoustic source (whose location is known) and the known microphone (whose location is known) is known and the TDOA between a known microphone and the unknown microphone for a substantially same sound emitted by the current acoustic source is known, the distance between the current acoustic source and the unknown microphone may be estimated. This is because the TDOA is proportional to the difference between the known distance and the unknown distance and may generally be described by the following set of equations:

$$t_k = \frac{d_k}{c}; \quad t_u = \frac{d_u}{c}; \quad TDOA = t_u - t_k; \text{ and} \quad \therefore TDOA = \frac{(d_u - d_k)}{c} \tag{1}$$

where $t_k$ is the arrival time for a known microphone, $t_u$ is the arrival time for an unknown microphone, $d_k$ is the distance between the source and the known microphone, $d_u$ is the distance between the source and the unknown microphone, and c is the speed of sound.

Figure 3:
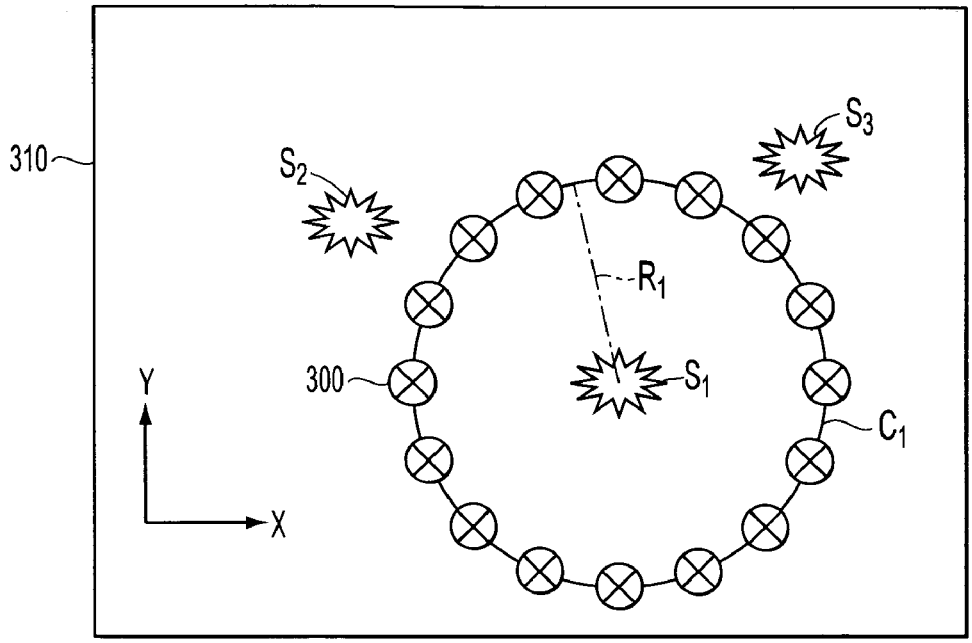
FIG. 3 shows the estimated locations of an unknown microphone using one known acoustic source in two-dimensions.

Accordingly, in step S1040, the distance between the unknown microphone and the current acoustic source is calculated. Then, in step S1050 the location of the unknown microphone is estimated based on the calculated distance between the unknown microphone and the current acoustic source. FIG. 3 shows the various estimated locations 300, in two dimensions, of the unknown microphone after the TDOA between a known microphone and the unknown microphone has been measured for one source $S_1$ and the distance between the source $S_1$ and the unknown microphone has been calculated.

As shown in FIG. 3, the estimated locations 300 are located along the circumference $C_1$ of a circle having radius $R_1$, where radius $R_1$ is equal to the calculated distance between the source $S_1$ and the unknown microphone. This is because simple geometry requires that an unknown point that is located a known distance from a known point must lie on a circumference of a circle around the known point whose radius is equal to the known distance. It should be appreciated that, if the dimensions of the room 310 (or any other predefined area) are known, any estimated location 300 that lies outside the room 310 may be discarded.

Next, in step S1060, it is determined whether all acoustic sources with known locations have been selected as the current acoustic source. If so, the location of the unknown microphone cannot be more precisely estimated and operation of the method jumps to step S1999, where the method terminates. If, however, all acoustic sources with known locations have not been selected as the current acoustic source, operation continues to step S1070.

In step S1070, it is determined whether the estimated position 300 of the unknown microphone is acceptable for the purposes of the user. If the estimated position 300 of the unknown microphone is acceptable, there is no reason to further refine the estimated position using additional sources. As such, operation continues to step S1999, where the method terminates. However, if the estimated position 300 of the unknown microphone is not acceptable, operation returns to step S1020, where a next acoustic source is selected as a current acoustic source.

Figure 4:
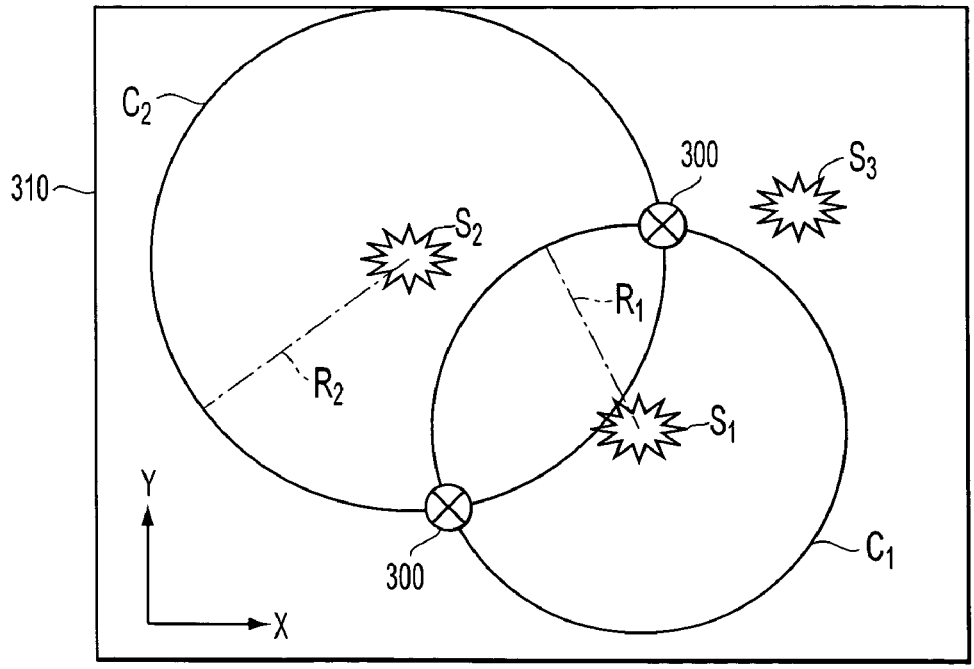
FIG. 4 shows the estimated locations of an unknown microphone using two known acoustic sources in two-dimensions.

FIG. 4 shows the various estimated locations 300, in two dimensions, of the unknown microphone after the TDOA between a known microphone and the unknown microphone has been measured for two sources $S_1$, $S_2$ and the respective distances between the sources $S_1$, $S_2$ and the unknown microphone have been calculated. As shown in FIG. 4, the possible estimated locations 300 for the unknown microphone lie on the intersection of the circumferences $C_1$, $C_2$ of circles centered on the two sources $S_1$, $S_2$ with radii $R_1$, $R_2$. Radii $R_1$ and $R_2$ are equal to the calculated distances between the respective sources $S_1$ and $S_2$ and the unknown microphone. This is because simple geometry requires that an unknown point that is a known distance from a first point and a known distance from a second point must lie on a point that is common to the two circumferences of circles which are respectively centered on the first and second points and have respective radii of the known distances.

Again, it should be appreciated that, if the dimensions of the room 310 are known, any estimated location 300 that lies outside the room 310 may be discarded. As a result, if one of the estimated locations shown in FIG. 4 were located outside the room 310, it could be discarded. Returning to FIG. 2, if the location of the unknown microphone had been estimated in two dimensions based on two sources (e.g., FIG. 4) and one of the estimated locations 300 were located outside the room, it is likely that the remaining estimated location would be determined to be acceptable in step S1070.

Figure 5:
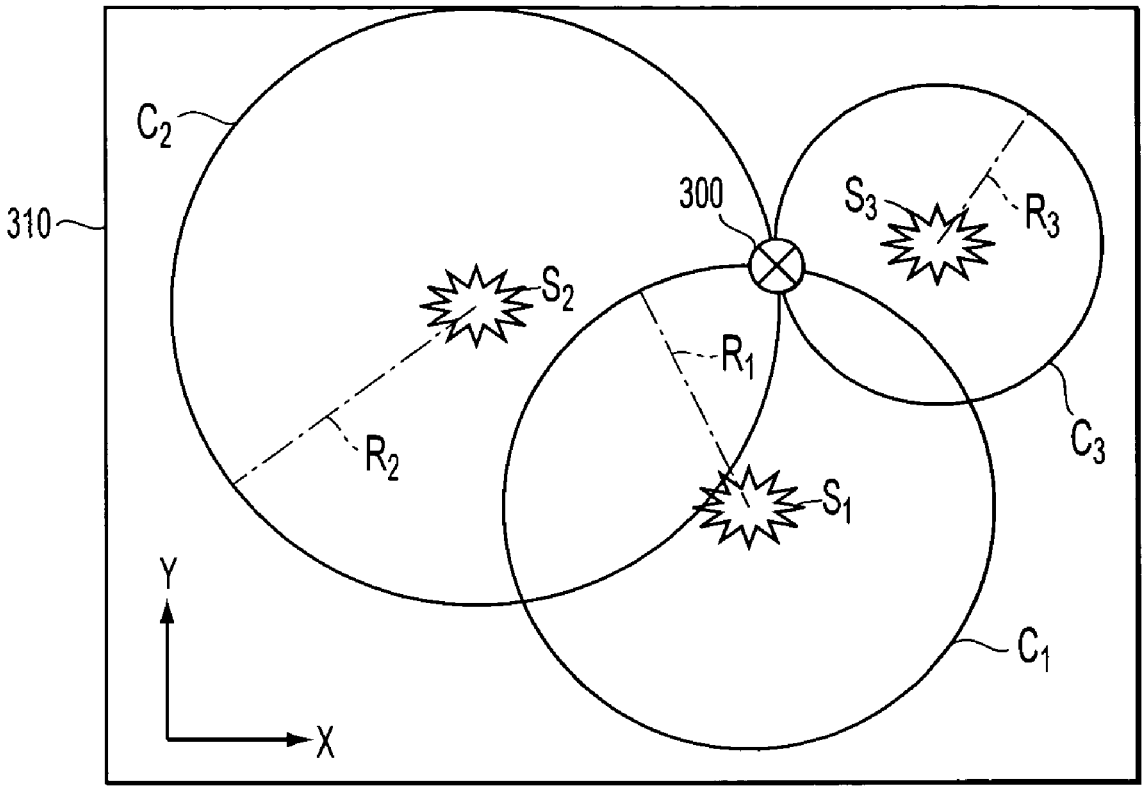
FIG. 5 shows the estimated locations of an unknown microphone using three known acoustic sources in two-dimensions.

FIG. 5 shows the various estimated locations 300, in two dimensions, of the unknown microphone after the TDOA between a known microphone and the unknown microphone has been measured for three sources $S_1$, $S_2$, $S_3$ and the respective distances between the sources $S_1$, $S_2$, $S_3$ and the unknown microphone have been calculated. As shown in FIG. 5, the possible locations 300 for the unknown microphone lie on the intersection of the circumferences $C_1$, $C_2$, $C_3$ of circles centered on the three sources $S_1$, $S_2$, $S_3$ with radii $R_1$, $R_2$, $R_3$. Radii $R_1$, $R_2$ and $R_3$ are equal to the distances between the respective sources $S_1$, $S_2$, and $S_3$ and the unknown microphone. This is because simple geometry requires that an unknown point that is a known distance from a first point, a known distance from a second point, and a known distance from a third point must lie on a point that is common to the three circumferences of circles which are respectively centered on the first, second, and third points and have respective radii of the know distances.

It is readily apparent from the foregoing that it is possible to reduce the above-described method into a system of equations that may be solved for the location of the unknown microphone. For example, if the two-dimensional plane of the room 310 is expressed in Cartesian coordinates, the three circumferences C1, C2, C3 described by the distances (R1, R2, R3) calculated using the TDOA for each acoustic source between the known microphone(s) and the unknown microphone, may be described by the following set of equations:

$$(x_1-X)^2+(y_1-Y)^2=(ct_1)^2$$

$$(x_2-X)^2+(y_2-Y)^2=(ct_2)^2$$

$$(x_3-X)^2+(y_3-Y)^2=(ct_3)^2 \tag{2}$$

In the above equations, the unknown microphone is located at point (X,Y), each known acoustic source $S_k$ is located at $(x_k,y_k)$, c represents the speed of sound, and $t_k$ represents the TDOA between a known microphone and the unknown microphone for each known source $S_k$.

Furthermore, it equally apparent from the above equations that in other exemplary embodiments, the location of an unknown microphone may be determined in three dimensions by substituting spheres for the circles in the first exemplary embodiment. Accordingly, in those embodiments, the location of the unknown microphone may be described by the following equations. Note that because there is an additional unknown variable (i.e., the unknown microphone's location in the Z-direction) in most cases it will be necessary to utilize a fourth source to obtain an additional equation. For example, if a three dimensional room were expressed in Cartesian coordinates, the location of the unknown microphone (X,Y,Z) may be described by the following set of equations:

$$(x_1-X)^2+(y_1-Y)^2+(z_1-Z)^2=(ct_1)^2$$

$$(x_2-X)^2+(y_2-Y)^2+(z_2-Z)^2=(ct_2)^2$$

$$(x_3-X)^2+(y_3-Y)^2+(z_3-Z)^2=(ct_3)^2$$

$$(x_4-X)^2+(y_4-Y)^2+(z_4-Z)^2=(ct_4)^2 \tag{3}$$

In the above equations, each known source $S_k$ is located at $(x_k,y_k,z_k)$, c represents the speed of sound, and $t_k$ represents the TDOA between a known microphone and the unknown microphone for each known source $S_k$.

Of course, the above-described embodiments explain the geometric relationship between the various known microphones, the acoustic sources, and the unknown microphone (s). However, in the case that the acoustic sources are located using the array of microphones with known locations (e.g., by using frequency based delay estimation), the system of equations can be more generally formulated as a non-linear optimization, without the need for a separate explicit solution for the location of each acoustic source. That is, according to various exemplary embodiments, the source locations can be estimated simultaneously with the location of the unknown microphone.

According to these exemplary embodiments, the observable values are the locations of the known microphones, $\overline{m}$, and the TDOA's between all microphone pairs (i.e., a known microphone and the unknown microphone), $\overline{\tau}$. The problem is then one of finding the "best" value of the unknown microphone location, $\overline{u}$, and the source locations, $\overline{s}_k$, given the distinct observed source locations (the arrows denoting that these are vector valued variables):

$$\bar{u}, \bar{s}_k = \text{argmin}\left(\sum_k E(\bar{u}, \bar{\tau}_k, \bar{m}, \bar{s}_k)\right) \quad (4)$$

The function $E(\bar{u}, \bar{\tau}_k, \bar{m}, \bar{s}_k)$ is a measure of the error of a particular solution, $\bar{u}$, $\bar{s}_k$, given the known microphone positions, $\bar{m}$, and the TDOA measurements, $\bar{\tau}_k$. For instance, in various exemplary embodiments, this function might be the squared error between the observed values for a particular solution:

$$E(\bar{u}, \bar{\tau}_k, \bar{m}, \bar{s}_k) = |\tau(\bar{u}, \bar{m}, \bar{s}_k) - \bar{\tau}_k|^2 \quad (5)$$

The function $\tau(\bar{u}, \bar{m}, \bar{s}_k)$ computes the expected TDOA's for the set of known microphones, $\bar{m}$, the estimated location for the unknown microphone, $\bar{u}$, and the estimated acoustic source locations, $\bar{s}_k$. Minimizing the function corresponds to the best solution of the system of equations presented above.

Furthermore, according to various exemplary embodiments, when information about the relative accuracy or variance of the TDOA measurements is available, a weighted solution may be implemented. For instance, the error function described above could incorporate a weighting function whereby the measurements with highest variance (or expected variance) are de-emphasized in the error function, while those with lower variance (higher accuracy) are emphasized. Similarly, according to various exemplary embodiments, observations can be weighted to emphasize those that are most recent and de-emphasize those further in the past.

As discussed above, according to the various exemplary embodiments of the invention, it is preferable that there be multiple acoustic sources. As evident from FIGS. 3-5, the more sources available, the more accurately the location of the unknown microphone may be estimated. According to various exemplary embodiments of the invention, a conversation between multiple people in a meeting will suffice for providing multiple sources. As talkers take turns speaking or shift their position they provide distinct sources for the positioning procedure. Also, a single talker (source) that walks, or otherwise moves, across the room while speaking will provide a set of source locations suitable for this purpose since accurate TDOA measurements may be performed on segments of speech on the order of 25 milliseconds during which a talker moving at reasonable speed is essentially still.

Even when talkers appear to speak over one another, the nature of speech is such that single-speaker segments can be identified given a short-time analysis. The signal processing is greatly simplified if it is assumed that only a single acoustic source is active at any particular time. With this assumption, according to various exemplary embodiments, measuring the TDOA between any pair of microphones is straightforwardly achieved through well known correlation methods.

In many cases an audio device may have some unknown latency associated with it. For instance, a networked audio device will have some coding and transmission latency. Typically, this type of latency is orders of magnitude greater than the TDOA to be calculated. Therefore, if this latency is unknown the time delay to this device cannot be estimated unambiguously and methods described herein to determine its location will become inaccurate.

According to various exemplary embodiments of the invention, it may be possible in some cases to measure the device latency with a calibration step that involves placing a microphone whose latency will be measured at a known position and measuring the TDOA of the device while it is at that known position. In this way, the difference between the expected TDOA for that position and the measured TDOA is the device latency.

In various other exemplary embodiments, a less intrusive method uses the same methods employed in the GPS system (with respect to clock offset). According to these embodiments, the device latency is simply another unknown value which is estimated during the solution of the above-described equations. When there is an unknown latency (which is assumed to be constant for the duration of the observations) in the device in question, the measured TDOA values will have a fixed bias corresponding to the latency of the device. As a result, the radius of the triangulation circles (2-D) or spheres (3-D) will be larger or smaller by a proportional amount and they will not intersect at a single point. For instance, increase the radius of all the range circles in FIGS. 3-5 by some fixed amount. By treating the latency as an unknown, it can be found by choosing the solution (which now includes the device latency as well as the known microphone location and possibly the acoustic source locations) that results in the closest intersection (best solution).

Similarly, according to various exemplary embodiments, the speed of sound (which varies as a function of temperature and humidity) can be treated as an unknown variable and solved for based upon the measurements. According to other various exemplary embodiments, the temperature and/or humidity adjusted speed of sound may be estimated if the temperature and/or humidity of the room are available, for instance from a conventional HVAC system, using well known equations.

It should be appreciated that, in the above described exemplary embodiments, as additional unknowns are introduced, more equations (unique acoustic source observations) are required to determine the solution. For example, as described above, if four source locations are required to unambiguously determine an unknown microphone location in three dimensions (three unknowns), five will be required to find a microphone location (three unknowns) and unknown channel latency (one unknown). Six will be required to find a microphone location (three unknowns), unknown channel latency (one unknown), and temperature/humidity adjusted speed of sound (one unknown).

According to various exemplary embodiments of the invention, it is conceivable that the positions of the set of microphones with known positions may not be exactly known. For instance, the microphones may be placed on a conference table corresponding to the seats, and the location of the table and seats known. Alternatively, the microphones may be placed along a podium in a certain order at a rough spacing, but their exact locations unknown. In these embodiments, the estimated location of each microphone may be incrementally improved by selecting each of the microphones as the unknown microphone and using the remaining microphones to determine the location of that microphone. Then, the process is repeated one or more times for each microphone. If the initial set of locations is relatively close to the actual locations of the microphones, the various estimated positions should converge on the exact location of each microphone. As a result, if the various exemplary embodiments of the invention were to be set up and used in an unfamiliar room (i.e., there is not an opportunity to exactly place the microphones), this calibration process would allow a user to more accurately determine the location of the known microphones prior to determining the location of any unknown microphone. The more accurate that the location of the known microphones is known, the more accurately the remaining variables may be calculated.

Figure 6:
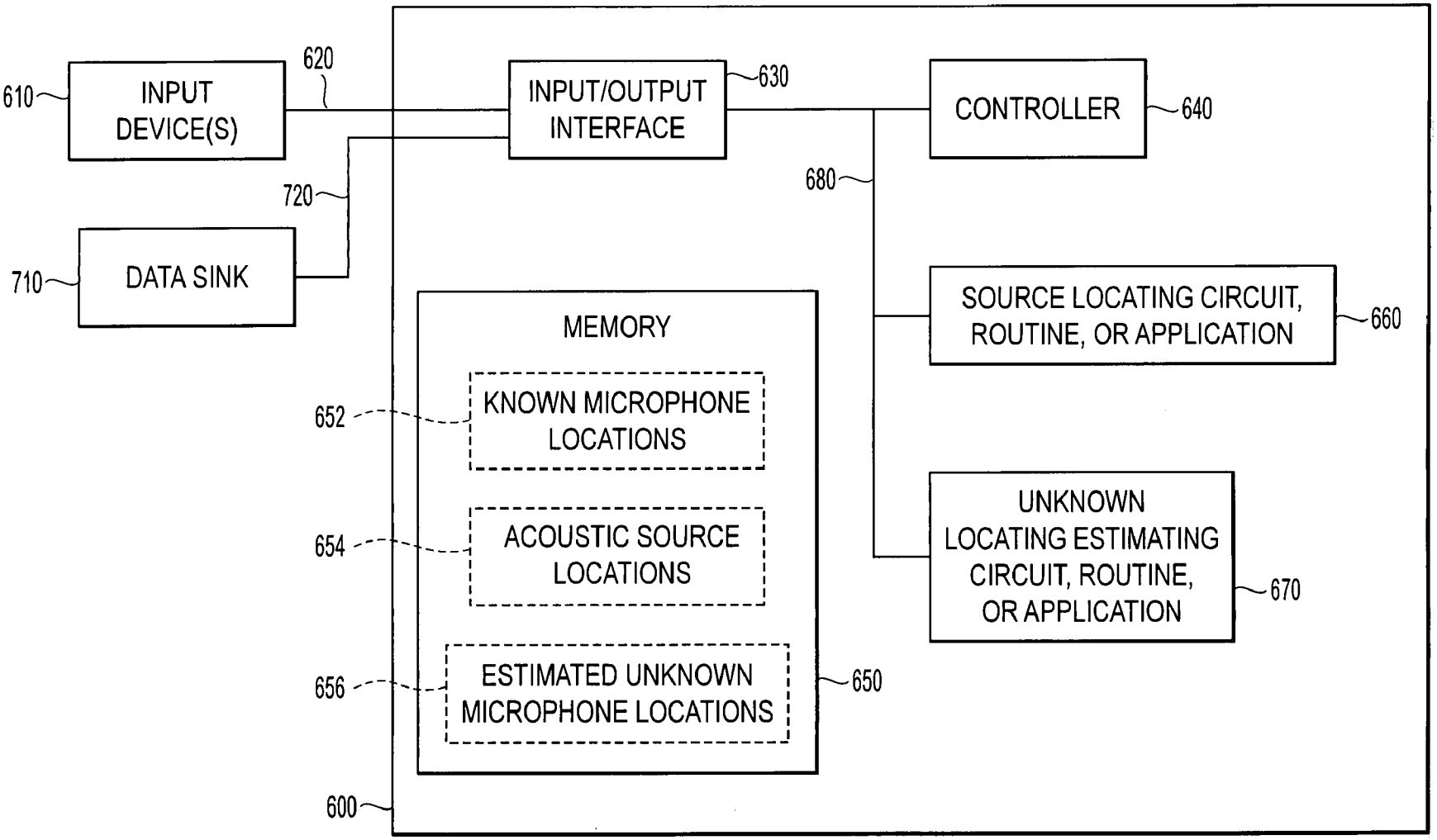
FIG. 6 is a functional block diagram of an exemplary embodiment of a system for determining a location of an unknown microphone according the invention.

FIG. 6 is a functional block diagram of an exemplary embodiment system 600 usable to determine a location of an unknown microphone according the invention. As shown in FIG. 6, the system 600 includes an input/output interface 630, a controller 640, a memory 650, a source locating circuit, routine, or application 660, and an unknown location estimating circuit, routine, or application 670, each appropriately interconnected by one or more data/control busses and/or application programming interfaces 680, or the like. The input/output interface 630 is connected to one or more input devices 610 over one or more links 620. The input device(s) 610 can be any device suitable for providing audio signals from microphones, such as an audio system, a wireless AV system, a telephony system, and/or a VOIP. The input device 610 can be any known or later-developed device or system that is capable of providing audio signals from microphones to the input/output interface 630 of the system 600.

The input device(s) 610 may also include one or more of a keyboard, a mouse, a track ball, a track pad, a touch screen, or any other known or later-developed device for inputting data and/or control signals to the system 600.

In this exemplary embodiment, the input/output interface 630 is connected to a data sink 710 over one or more links 720. In general, the data sink 710 can be can be any device or system capable of receiving and using, processing, and/or storing data representing the location of the unknown microphone determined by the system 600. For instance, the data sink may be a video system, a television system, a teleconference system, a lighting system, or any other system which is capable of utilizing the location of an unknown microphone or the location of a person or device associated with the unknown microphone.

Additionally, the data sink 710 may be a locally or remotely located laptop or personal computer, a personal digital assistant, a tablet computer, a device that receives and stores and/or transmits electronic data, such as for example, a client or a server of a wired or wireless network, an intranet, an extranet, a local area network, a wide area network, a storage area network, the Internet (especially the World Wide Web), and the like. In general, the data sink 710 can be any device that is capable of receiving and using, processing, and/or storing data representing the location of the unknown microphone that is provided by the one or more links 720.

Each of the various links 620 and 720 can be implemented using any known or later-developed device or system for connecting the input device(s) 610, the and/or the data sink 720, respectively, to the input/output interface 630. In particular, the links 620 and 720 can each be implemented as one or more of a direct cable connection, a connection over an audio and/or visual system, a connection over a wide area network, a local area network, a connection over an intranet, a connection over an extranet, a connection over the Internet, a connection over any other distributed processing network or system, or an infrared, radio-frequency, or other wireless connection.

As shown in FIG. 6, the memory 650 contains a number of different memory portions, including a known microphone locations portion 652, an acoustic source locations portion 654, and an estimated unknown microphone locations portion 656. The known microphone locations portion 652 stores the locations of the known microphones. The acoustic source locations portion 654 stores the known or calculated locations of the acoustic sources. The estimated unknown microphone locations portion 656 stores the estimated locations of the one or more unknown microphones.

The memory 650 shown in FIG. 6 can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writeable or re-rewriteable optical disk and disk drive, a hard drive, flash memory or the like. Similarly, the non-alterable or fixed memory can be implemented using any one or more of ROM, PROM, EPROM, EEPROM, an optical ROM disk, such as CD-ROM or DVD-ROM disk, and disk drive or the like.

The source locating circuit, routine, or application 660 inputs audio signal information from known microphones and outputs information representing the location of the acoustic source of the audio signal information. The unknown location estimating circuit, routine, or application 670 inputs audio signal information from an acoustic source with a known location received by a microphone with an unknown location, audio signal information from the acoustic source with an unknown location received by a microphone with a known location, and the location of the acoustic source and outputs information representing the location of the microphone with the unknown location.

In operation, the system 600, inputs location data of known microphones from the input device(s) 610 across link 620 to the input/output interface 630. Under control of the controller 640, the location data of the known microphones is stored in the known microphone locations portion 652 of the memory 650. Next, if the location of one more acoustic sources is known, the system 600 inputs the source location data from the input device(s) 610 across link 620 to the input/output interface. Under control of the controller 640, the source location data is stored in the acoustic source locations portion 654 of the memory 650.

If one or more acoustic source locations must be determined, the system inputs one or more groups of audio signals representing a substantially same sound emitted by the same acoustic source and received by at least two of the known microphones from the input device(s) 610 across link 620 to the input/output interface 630. Then, under control of the controller 640, the audio signals are input into the source locating circuit, routine, or application 660. Under control of the controller 640, the source locating circuit, routine, or application 660 accesses the known microphone location data in the known microphone locations portion 652, and computes the location of the one or more sources. The computed source locations, under control of the controller 640, are then stored in the known microphone locations portion 652.

Next, the system 600 inputs one or more group of acoustic signals respectively received by at least one of the known microphones and the unknown microphone, each audio signal group generated by the same known audio source, from the input device(s) 610 across link 620 to the input/output interface 630. Under control of the controller 640 the input audio signal group(s) are input into the unknown location estimating circuit, routine, or application 670. Under control of the controller 640, the unknown location estimating circuit, routine, or application 670 accesses the known microphone location data and the acoustic source location data from the known microphone locations portion 652 and the acoustic source location portion 654, respectively, and outputs the estimated location of the unknown microphone. Then, under control of the controller 640, the estimated location of the unknown microphone is stored in the estimated unknown microphone locations portion 656 of the memory 650. Alternatively, under control of the controller 640, the estimated location of the unknown microphone may be output directly from the unknown location estimating circuit, routine, or application 670 via the input/output interface across link(s) 720 to the data sink 710.

It should be appreciated that, depending on cost or other design constraints, one or more of the above-described elements of the system 600 may be combined into a single element or divided into multiple elements where appropriate. For instance, in the case that the locations of acoustic sources and the unknown microphone are determined simultaneously, the source locating circuit, routine, or application 660 and the unknown location estimating circuit, routine, or application 670 may be properly combined.

According to the above-described exemplary embodiments, it is possible to locate the position of an unknown microphone (and therefore persons and/or objects associated with the microphone) within a predefined area containing an audio system and number of microphones without the need for employing additional hardware and/or software, than that which already exists. This allows for the location of the persons and/or objects without the expense and resources required to install and operate a dedicated tracking system.

Furthermore, according to the above-described exemplary embodiments, the persons and/or objects may be located without the persons and/or objects themselves having to make a sound (i.e., as in merely locating the acoustic sources). This allows for the location of certain speakers, for example, at a news conference or teleconference, to be located prior to their speaking. As a result, for example, a camera, light, or microphone may be directed towards that speaker's location before they speak, allowing for a seamless audio or video signal. Additionally, for example, during a debate, in a court room, or the like, a camera, light, or microphone may be directed towards another party to get their reaction to a speaker or event, even though that party has not spoken yet.

According to the above-described exemplary embodiments, it is possible to track a moving microphone. Suppose that a certain speaker was continually moving during a presentation. According to various exemplary embodiments, it would be possible to repeatedly calculate the location of the unknown microphone. Each subsequent calculated location would be the updated location of the moving speaker. For example, the location might be determined for segments of sound from a known source on the order of 25 milliseconds during which a the unknown microphone, moving at reasonable walking speed, is essentially still.

Furthermore, according to the above-described exemplary embodiments, it is possible to determine the location of certain devices with built in microphones. For instance, assume a number of devices are connected to a temporary network, for example, during a meeting. It would be possible to locate one or more of the devices by using their built-in microphone according to the various exemplary embodiments of the invention. If each device is assigned an address within the temporary network based on, for example, its position around a table, or its position within the room, each device could be matched with the temporary network address and a confidential electronic message could be sent to one or more of the devices.

According to the above-described exemplary embodiments, it is also possible to actively determine the location of certain devices with built in microphones by using an ultrasonic continuous reference tone emitted from one or more speakers as a source to locate the unknown microphone. For instance, a plurality of ultrasonic-capable speakers (or more likely, dedicated ultrasonic transducers) could be producing ultrasonic audio probe signals that are separable, either in time (time-multiplexing), frequency (frequency-multiplexing), or code (spread spectrum modulation or code-multiplexing) and as long as the microphone and associated digitization system in question can detect those signals it can be located completely from these ultrasonic probes.

In principle, the above-described ultrasonic version is a special case of using any known playback signal (i.e., audible or ultrasonic) from a known location (playback speaker) in the source-location/time-difference processing. However, the use of ultrasonic tones would prevent audible interference within the audio system that may interfere with the primary use of the audio system.

While this invention has been described in conjunction with the exemplary embodiments outlined above, various alternatives, modifications, variations, and/or improvements may be possible. Accordingly, the exemplary embodiments of the invention, as set forth above, are intended to be illustrative. Various changes may be made without departing from the spirit and scope of the invention.

What is claimed is:

1. A method for determining the location of a microphone, comprising:

determining a difference in an arrival time between a first audio signal generated by one microphone with a known location and a second audio signal generated by another microphone with an unknown location, wherein the first and second audio signals are a representation of a substantially same sound emitted from a plurality of acoustic sources with a known location;

determining, based on at least the determined difference in arrival time, distances between the plurality of acoustic sources with the known location and the microphone with the unknown location; and determining, based on the determined distances of the acoustic source and the microphone with the unknown location, the location of the microphone with the unknown location, wherein the first and second audio signals are representations of a sound emitted from an acoustic source other than an acoustic source speaking into the unknown microphone.

2. The method of claim 1, wherein each of the method steps are performed substantially simultaneously.

3. The method of claim 1, wherein a same acoustic source in a different known location is considered a different acoustic source.

4. The method of claim 1, wherein determining, based on at least the determined difference in arrival time, the distance between the acoustic source with the known location and the microphone with the unknown location comprises:

determining a device latency for the microphone with the unknown location; and determining, based on the determined device latency for the microphone with the unknown location, the distance between the acoustic source with the known location and the microphone with the unknown location.

5. The method of claim 1, wherein determining, based on at least the determined difference in arrival time, the distance between the acoustic source with the known location and the microphone with the unknown location comprises:

determining a speed of sound; and determining, based on the determined speed of sound, the distance between the acoustic source with the known location and the microphone with the unknown location.

6. The method of claim 1, wherein determining, based on at least the determined difference in arrival time, the distance between the acoustic source with the known location and the microphone with the unknown location comprises:

determining a device latency for the microphone with the known location; and determining, the device latency for the microphone with the known location, the distance between the acoustic source with the known location and the microphone with the unknown location.

7. The method of claim 1, wherein the microphone with the unknown location is incorporated into a laptop computer.

8. The method of claim 1, wherein the microphone with the unknown location is incorporated into a wired telephone.

9. The method of claim 1, wherein the microphone with the unknown location is incorporated into a cellular telephone.

10. The method of claim 1, wherein the microphone with the unknown location is incorporated into a personal digital assistant.

11. The method of claim 1, wherein the microphone with the unknown location is incorporated into a laptop computer.

12. The method of claim 1, wherein the microphone with the unknown location is a wireless microphone.

13. The method of claim 1, wherein the substantially same sound is an audible sound.

14. The method of claim 1, wherein the substantially same sound is an ultrasonic sound.

15. A system for determining the location of a microphone, comprising:

an acoustic source locating circuit that determines the location of acoustic sources using two or more microphones with known locations; and an unknown location estimating circuit that determines the location of one or more unknown microphones, based on audio signals generated by a microphone with a known location and an audio signal generated by another microphone with an unknown location, wherein the audio signals are a representation of a substantially same sound emitted from the same acoustic source with a known location, and wherein the unknown location estimating circuit accesses location of the microphone with the known location and the location of the acoustic sources and outputs estimated locations of the one or more unknown microphones.

16. The system of claim 15, wherein the acoustic source locating, circuit, and the unknown location estimating circuit are embodied in a single circuit.

17. The system of claim 15, wherein the location of one or more acoustic sources and the location of one or more unknown microphones are determined substantially simultaneously.

18. An audio system comprising the system of claim 15.

19. A method for passive estimation of location of an unknown microphone in a space, the unknown microphone having an unknown location, the method comprising:

determining locations of acoustic sources in the space;

determining locations of known microphones in the space, the known microphones having known locations;

selecting a first acoustic source from among the acoustic sources as a current acoustic source, the current acoustic source generating a sound;

determining a time difference of arrival between a time of arrival of the sound at the unknown microphone and a time of arrival of the sound at one of the known microphones;

determining a distance between the unknown microphone and the current source from the time difference of arrival; and estimating the unknown location from the distance and one or more further distances determined from selecting a further acoustic source from among the acoustic sources as the current acoustic source and determining a further distance between the unknown microphone and the current acoustic source, wherein the acoustic sources are not associated with the unknown microphone.

* * * * *